US008966946B2

(12) United States Patent
Lai

(10) Patent No.: US 8,966,946 B2
(45) Date of Patent: Mar. 3, 2015

(54) COMBINATION KEY LOCK BOX WITH ANTI-PICK MECHANISM

(71) Applicant: The Sun Lock Company, Ltd., Tuen Mun, N.T. (HK)

(72) Inventor: Karl Lai, Hong Kong (HK)

(73) Assignee: The Sun Lock Company, Ltd., Tuen Mun, N.T. (HK)

( * ) Notice: Subject to any disclaimer, the term of this patent is extended or adjusted under 35 U.S.C. 154(b) by 0 days.

(21) Appl. No.: 14/164,996

(22) Filed: Jan. 27, 2014

(65) Prior Publication Data

US 2014/0352371 A1 Dec. 4, 2014

Related U.S. Application Data

(60) Provisional application No. 61/828,016, filed on May 28, 2013.

(51) Int. Cl.
*E05B 65/52* (2006.01)
*E05B 37/02* (2006.01)

(52) U.S. Cl.
CPC ..... *E05B 37/025* (2013.01)
USPC ..... 70/63; 70/25; 70/312; 292/252

(58) Field of Classification Search
CPC ..... E05B 67/00; E05B 67/02; E05B 67/22; E05B 37/00; E05B 37/0003; E05B 37/0048; E05B 37/0058; E05B 37/055; E05B 37/0068; E05B 37/02; E05B 37/025; E05B 65/52
USPC ..... 70/22, 24–26, 6, 286–288, 291–294, 70/301–304, 311, 312, 323, 327, 63; 292/252
See application file for complete search history.

(56) References Cited

U.S. PATENT DOCUMENTS

| | | | | | |
|---|---|---|---|---|---|
| 717,350 | A * | 12/1902 | Churchill | 70/312 |
| 948,598 | A * | 2/1910 | Stuart | 292/73 |
| 1,955,809 | A * | 4/1934 | Hobbs | 109/23 |
| 4,576,022 | A * | 3/1986 | Gamble | 70/55 |
| 4,718,259 | A * | 1/1988 | Appelbaum | 70/63 |
| 4,733,548 | A * | 3/1988 | Ling | 70/25 |
| 4,838,052 | A * | 6/1989 | Williams et al. | 70/63 |
| 7,775,073 | B2 * | 8/2010 | Green | 70/312 |
| 8,695,385 | B2 * | 4/2014 | Meekma et al. | 70/63 |
| 8,739,583 | B2 * | 6/2014 | Avganim | 70/58 |
| 2006/0213237 | A1 * | 9/2006 | Yang | 70/63 |
| 2009/0031764 | A1 * | 2/2009 | Huang | 70/21 |
| 2009/0151402 | A1 * | 6/2009 | Lee | 70/25 |
| 2011/0079056 | A1 * | 4/2011 | Sakai et al. | 70/52 |
| 2012/0060570 | A1 * | 3/2012 | Yang | 70/63 |
| 2013/0118215 | A1 | 5/2013 | Lai | |

FOREIGN PATENT DOCUMENTS

| | | |
|---|---|---|
| GB | 255258 | 9/1925 |
| JP | 2001-12121 | 1/2001 |

* cited by examiner

*Primary Examiner* — Lloyd Gall
*Assistant Examiner* — Amanda L Miller

(57) ABSTRACT

A combination key lock box comprising a body housing has a storage compartment which has holes to receive the toe of a shackle and the heel of the shackle. The heel or long-leg of the shackle remains inside of the body housing and the toe or short-leg can be moved away from the body to a lock releasing position. The shackle can be released from the body from the locked position to the open position by pushing down on the shackle to turn the dials to a correct combination. The heel of the shackle engages with the hole of the storage compartment cover to prevent the storage compartment from unlocking until the shackle has been released.

10 Claims, 10 Drawing Sheets

COMBINATION KEY LOCK BOX WITH ANTI-PICK MECHANISM

CROSS-REFERENCE TO RELATED APPLICATIONS

This application claims the benefit of U.S. Provisional Application No. 61/828,016, filed May 28, 2013, which is hereby incorporated by reference in its entirety.

TECHNICAL FIELD

The present invention relates to a combination key lock box.

BACKGROUND OF THE INVENTION

A key lock box is a useful device when one forgets his key for the house because a spare key, which is placed inside a key lock box, can be used to gain the access of entrance of the house. In addition, a real estate agent can place the house key in the key lock box on the door knob to gain access to the house without carrying many keys around with him. Often, these key lock boxes in the existing market are with combination locking mechanisms, however, many of these mechanisms have a drawback of being able to be picked very easily within seconds.

SUMMARY OF THE INVENTION

The present invention relates to a combination key lock box that requires the user to push down the shackle to turn the dials to the correct combination to open the lock. As a result of this feature, an intruder cannot pull the shackle of the lock upward to feel the correct combination because the dials do not rotate when the lock is in a locked position and the shackle is pulled away from the body of the lock.

The lock comprises a plurality of clutches, wherein each clutch includes nine faulty notches and one lock-opening notch. The clutch structure reduces the likelihood of the lock being picked by an intruder. The lock also comprises a tube with a spring biasing the tube upward towards the short leg of the shackle.

In the locked mode, as the shackle is being pushed upward away from the lock body, extended protrusions on the long leg of the shackle engage with the faulty notches of the clutches, thereby preventing the dials of the lock from rotating. In the locked mode, the user can push and hold the shackle downward toward the lock body such that the extended protrusions disengage from the faulty notches of the clutches, to allow the user to rotate the dials. The rotation of the dials causes the clutches to rotate such that the lock-opening notch of each clutch aligns with the extended protrusions of the shackle when the dials are set to the correct combination to allow the shackle to release out of the lock body.

In the locked mode, an end of the long leg of the shackle is engaged with a hole of the lock box cover and a tail of the tube is engaged with a separate hole of the lock box cover, thereby securely locking the lockbox cover in a closed position. When the lock is opened, the shackle is pulled in an upward position and the tube is pushed upward by the spring. The long leg end of the shackle and the tail of the tube thereby move upward and disengage with the holes in the lock box cover. As a result, the user can release the cover by pulling the cover open, and can store and/or remove keys or other items inside of the storage compartment of the lock body.

DETAILED DESCRIPTION OF THE INVENTION

Figure 1:
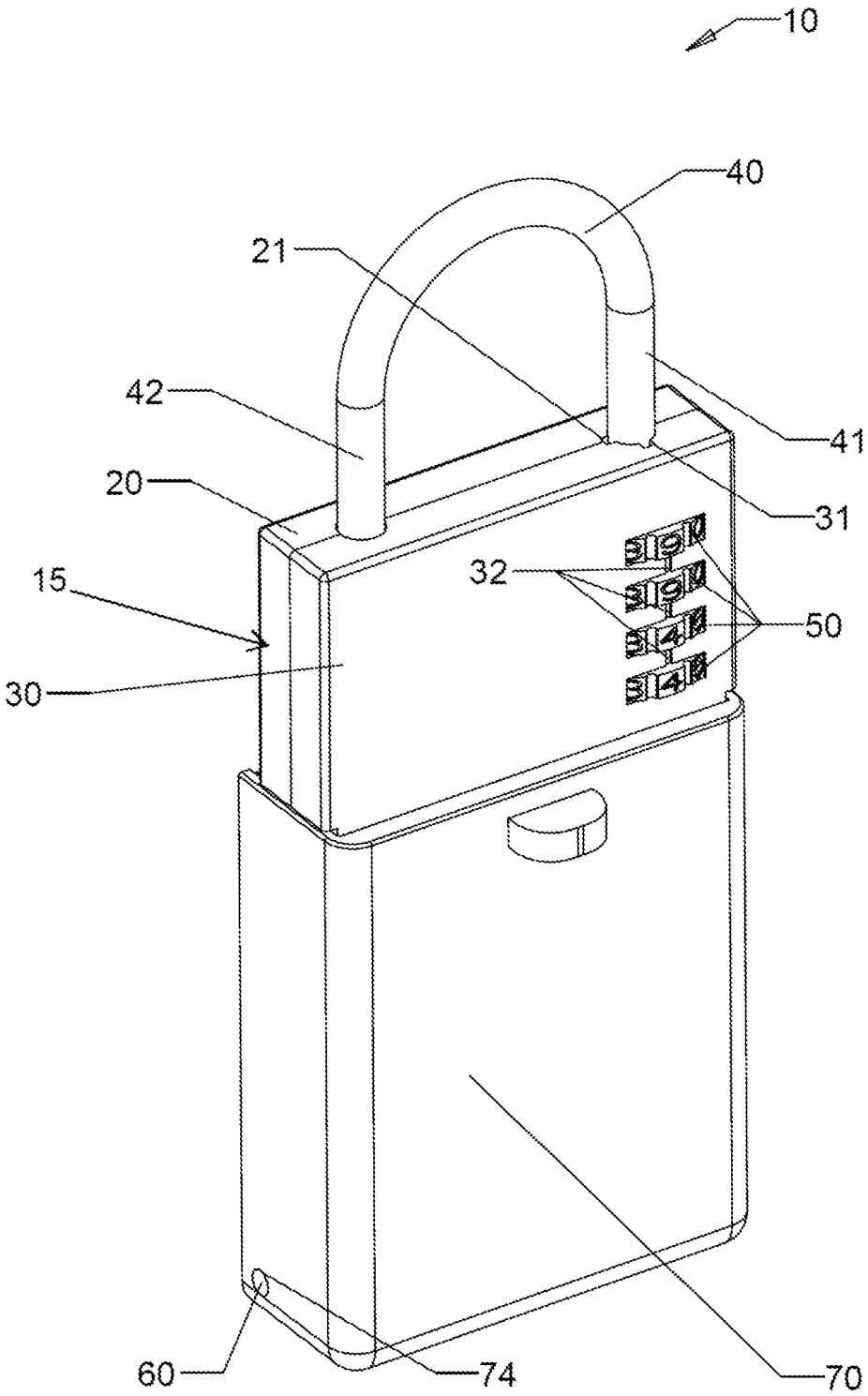
FIG. 1 shows the combination key lock box according to the present invention in the locked position.

As shown in the FIGS. 1-6, the present invention relates to a combination key lock box 10 that requires the user to push down the shackle 40 towards the first lock body 20 and second lock body 30 to turn the dials 50 in order to open the lock.

Figure 7:
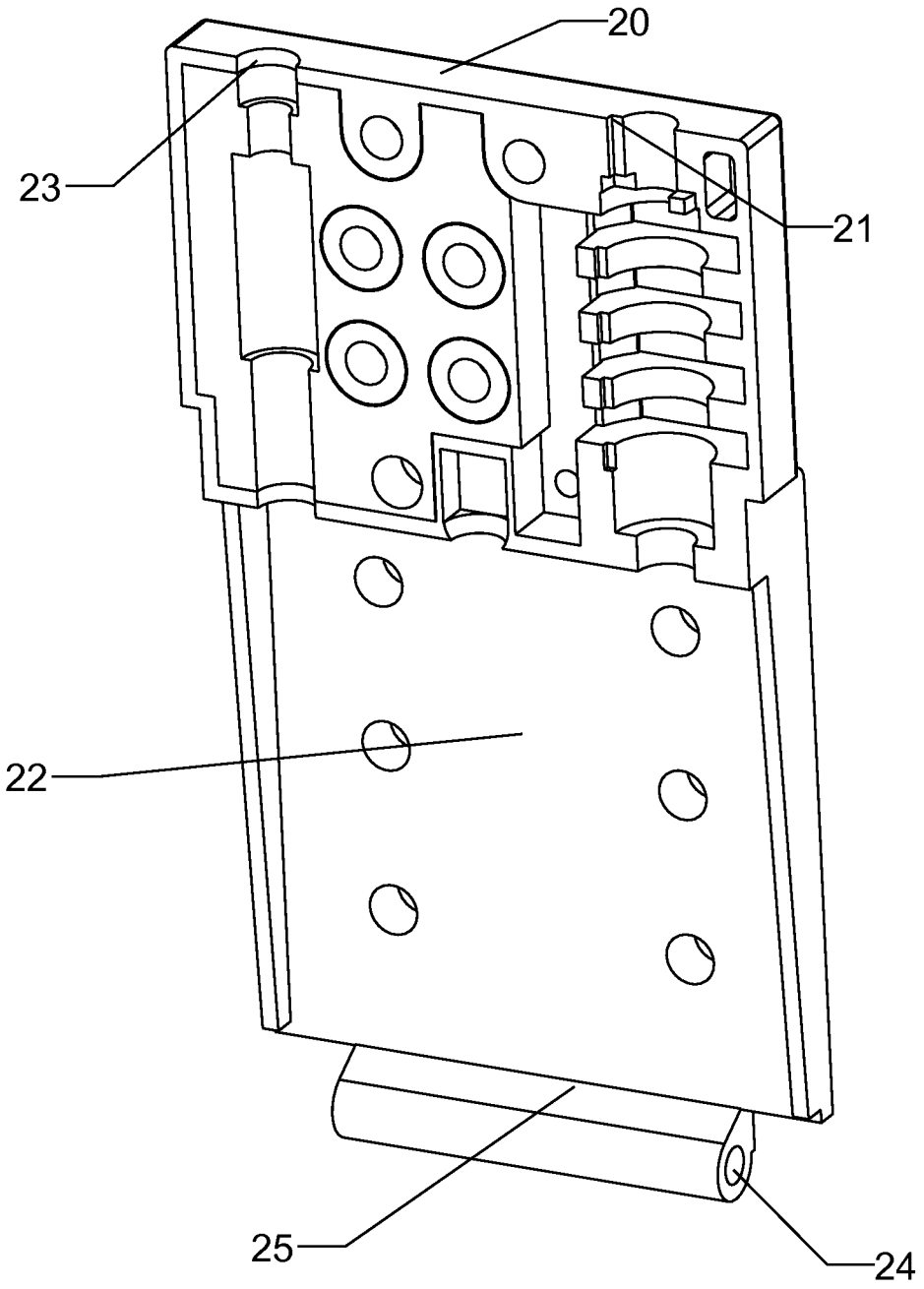
FIG. 7 shows a first lock body section of the combination key lock box according to the present invention in the position.
Figure 8:
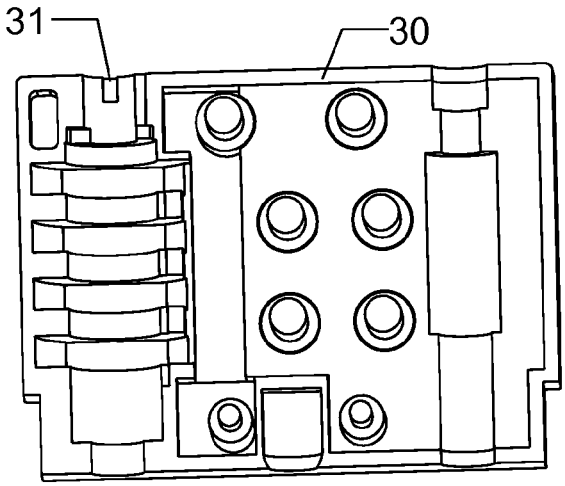
FIG. 8 shows a second lock body section of the combination key lock box according to the present invention in the position.

The combination key lock box 10 comprises a body housing 15 formed by a first lock body 20 and a second lock body 30, shown in FIGS. 7 and 8 respectively. The body housing 15 contains various elements of the lock box 10, including the long leg 41 and short leg 42 of the shackle 40, the dials 50, clutches 80, tube 90 and spring 100. The top of the body housing 15 is configured with a first slot 21 and a second slot 31 formed in the first lock body 20 and second lock body 30, each of which is dimensioned for a protrusion 43 on the long leg 41 of the shackle 40 to pass through. A hole 23 in the body housing 15 is dimensioned for receiving the short leg 42 of the shackle 40. Either or both of the first lock body 20 or second lock body 30 are configured with openings to correspond to the placement of the dials 50 within the body housing 15, so that a portion of the dials 50 are visible externally.

Figure 9:
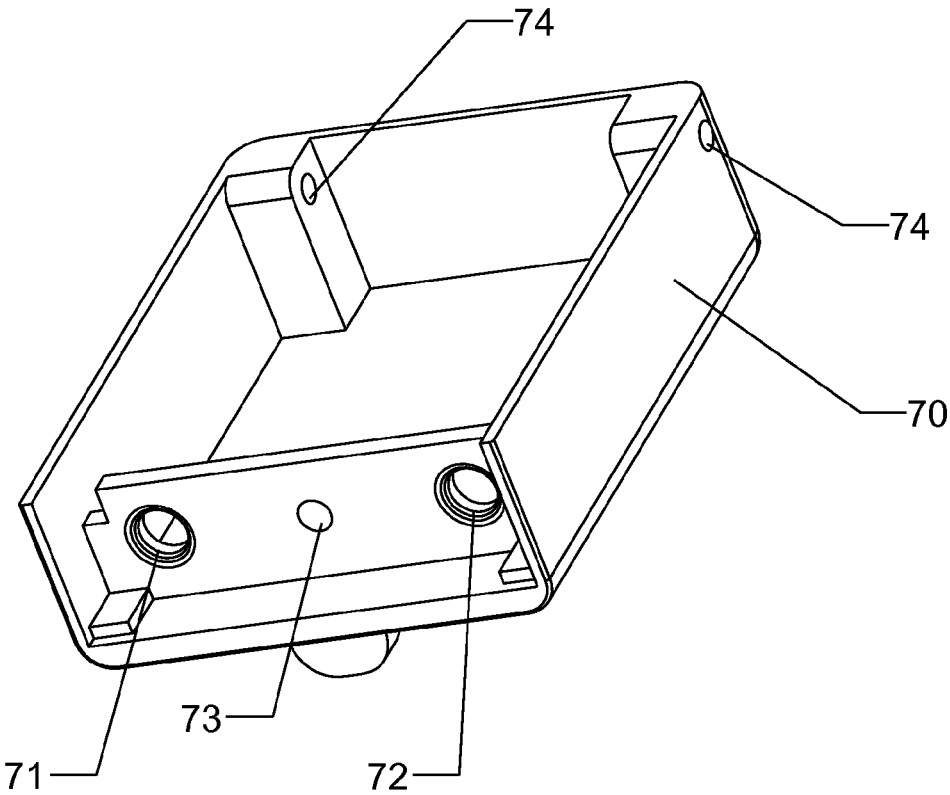
FIG. 9 shows the cover of the combination key lock box according to the present invention.

The combination key lock box 10 also includes a storage compartment 22 formed between a section of first lock body 20 and a cover 70. In one embodiment shown in FIG. 2, the bottom-end 25 of the storage component 22 includes a rod 60 to secure the first lock body 20 and cover 70. The rod 60 is riveted through rod-receiving hole 24 of the first lock body 20 and two holes 74 on the cover 70 which securely holds the storage compartment 22 and the cover 70 together and allows the cover 70 to pivot away from the storage component 22 in order to open the storage component 22. As seen in FIG. 9, the cover 70 further comprises locking holes 71 and 72 configured to engage the tube 90 and long leg 41 of the shackle 40, respectively. The cover 70 is configured to engage either or both of the shackle 40 and tube 90 in order to securely close the cover 70 and the storage compartment 22. It is noted that the cover 70 and storage compartment 22 are not limited to the embodiments shown in the Figures, but may include modifications within ordinary skill in the art.

In the locked mode, long leg end 45 of the shackle 40 is engaged with the hole 72 of the cover 70. Further, in the locked mode, the tail 92 of the tube 90 is engaged with the hole 71 of the cover 70. Because both holes 71 and 72 are engaged with the tail 92 of tube 90 and long leg end 45 of the shackle 40, respectively, the cover 70 is securely locked and cannot be pulled to open. In alternative embodiments, the cover 70 may be secured by only one of the tube 90 or shackle 40, and may comprise alternative means to the holes 71 or 72 to secure the cover 70 closed.

Figure 12:
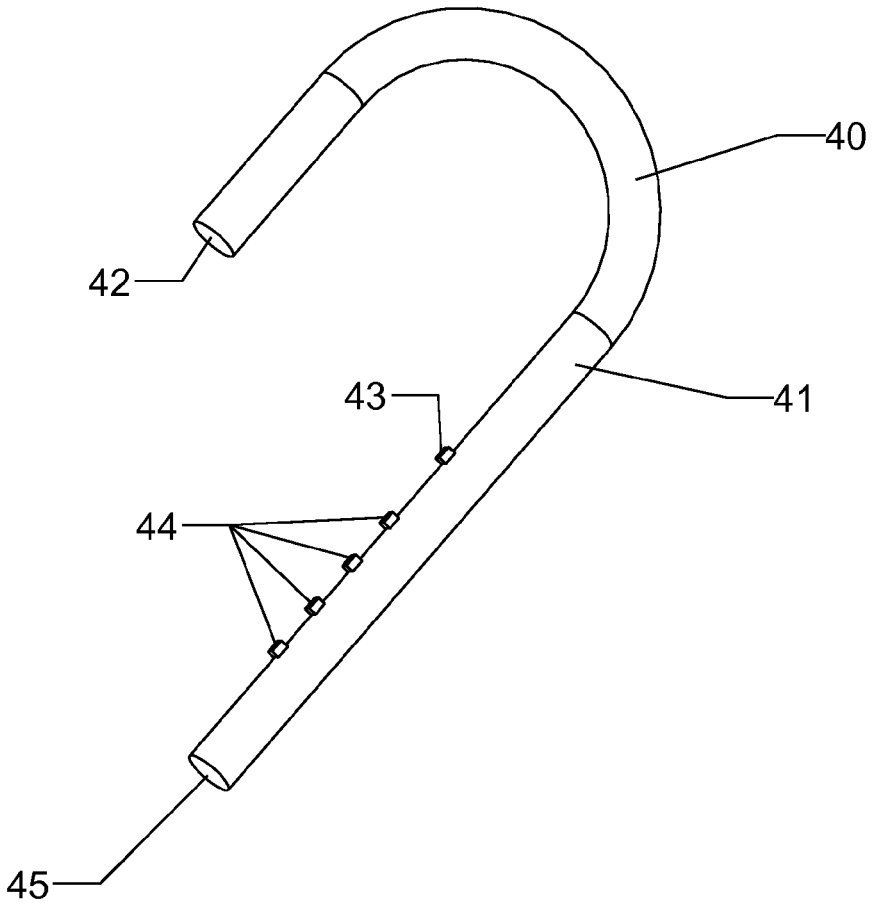
FIG. 12 shows the shackle of the combination key lock box according to the present invention.
Figure 13:
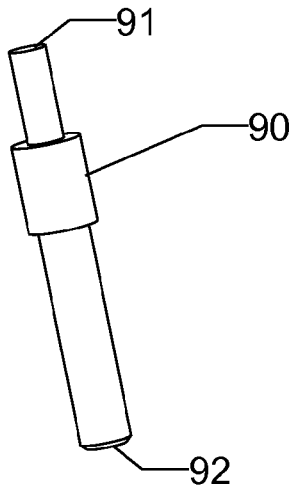
FIG. 13 shows the tube of the combination key lock box according to the present invention.

As seen in FIG. 12, the shackle 40 is formed with a long leg 41 and a short leg 42. The long leg 41 of the shackle 40 includes a first protrusion 43 and a series of extended protrusions 44. The extended protrusions 44 are in alignment with each other. The short leg 42 of the shackle 40 is contacted by the top end 91 of the tube 90. The spring 100 biases the tube 90 towards the short leg 42, thereby applying a force towards releasing the shackle 40 from the body housing 15.

Figure 10A:
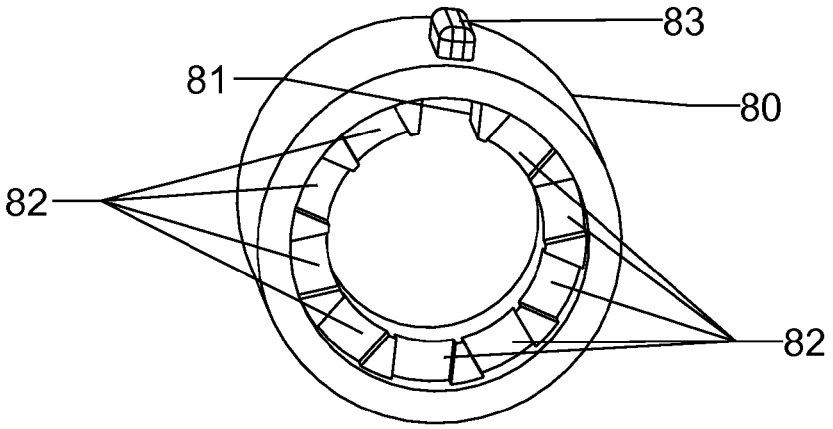
FIG. 10A shows a first view of a clutch of the combination key lock box according to the present invention.
Figure 10B:
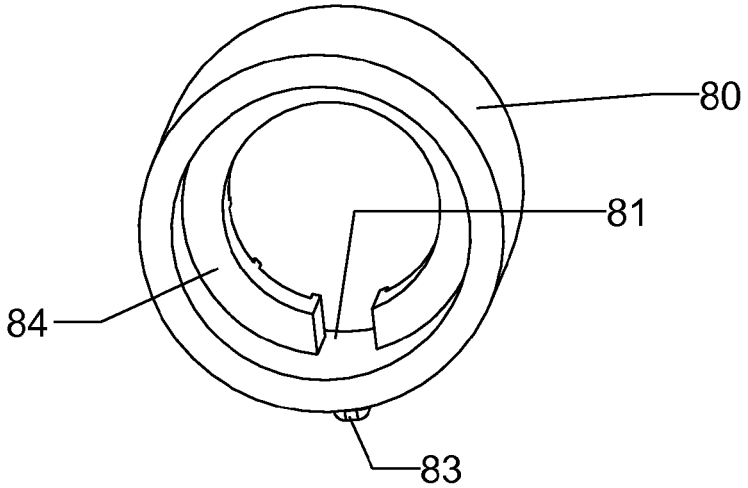
FIG. 10B shows a second view of a clutch of the combination key lock box according to the present invention.
Figure 11:
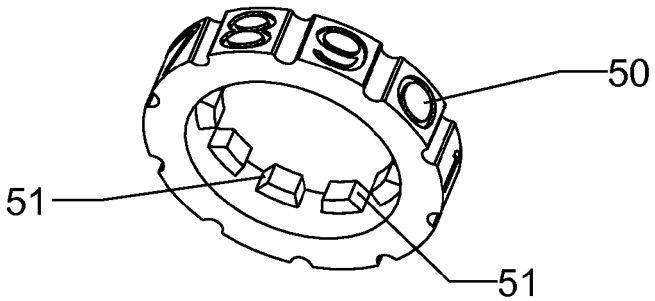
FIG. 11 shows a dial of the combination key lock box according to the present invention.

The lock box 10 includes a plurality of dials 50 and a plurality of clutches 80, which are shown individually in FIG. 11 and FIGS. 10A and 10B, respectively. Each of the dials 50 contains a series of external indicia or symbols, such as a series of numbers (0-9). The internal circumference of the dial 50 comprises a plurality of teeth 51. The teeth 51 are configured such that the space between a pair of adjacent teeth 51 is dimensioned to engage an extended fin 83 of a clutch 80. By engaging the extended fin 83 of the clutch 80 with the teeth 51, rotation of the dial 50 further causes a rotation of a clutch 80, and preventing the rotation of the clutch 80 further prevents rotation of the dial 50.

The clutch 80 further comprises a single lock-opening notch 81 and plurality of faulty notches 82, as can be seen in FIG. 10A. In the embodiment shown in the Figures, there are nine faulty notches 82 in view of the ten symbols indicated on the dial 50. As shown in FIG. 10B, there is a flat surface 84 on the side opposite the faulty notches 82. There is a segment of the flat surface 84 removed however in the position of the lock-opening notch 81. The width of a faulty notch 82 is configured to receive and engage one of the extended protrusions 44 of the shackle 40. As a result, when an extended protrusion 44 is engaged with a faulty notch 82, the extended protrusion 44 and the shackle 40 are blocked by the sides of the faulty notch 82 from rotating laterally and are blocked from moving in an upward direction (relative to the configuration shown in FIG. 2 for example), because the faulty notch 82 is not opened in that direction. Because the lock-opening notch 81 is open for vertical, upward movement, when each of the extended protrusions 44 are aligned with each of the lock-opening notches 81, the extended protrusions 44 can pass through the notches 81 and the shackle 40 can move in an upward direction.

In the embodiment shown in the Figures and described herein, there are an equal number of dials 50, clutches 80 and extended protrusions 44, such that each clutch 80 corresponds to a single dial 50 and a single extended protrusion 44.

As a result of this unique configuration, an intruder cannot pull the shackle 40 upward away from body housing 15 to feel the correct combination because the dials 50 cannot rotate when in the locked position. In the locked mode, as the shackle 40 is being pushed upward by the spring 100, the extended-protrusions 44 of the shackle 40 will engage with the faulty notches 82 of the clutches 80, which prevents the dials 50 from rotating. In the locked mode, the user can push and hold the shackle 40 downward such that the extended-protrusions 44 will disengage from the faulty notches 82 of the clutches 80 and allow the user to rotate the dials 50. The rotation of the dials 50 rotate the clutches 80 such that the opening notch 81 of each clutch 80 will align with the extended protrusions 44 of the shackle 40 to allow the shackle 40 to release out of the locking hole 23 of the body housing 15. In the opened mode, when the dials 50 are in the correct combination, the lock-opening notches 81 are aligned with the extended-protrusions 44 of the shackle 40, which allows the shackle 40 to be pulled open in an upward position. As the shackle 40 is released in an upward direction, the tube 90 is pushed by the spring 100 in the same direction. In such an arrangement, the long leg end 45 of the shackle 40 will move upward and disengage with the locking hole 72 of the cover 70. The tail 92 of the tube 90 is also disengaged with the locking hole 71 of the cover 70. As a result, the user can release the cover 70 by pulling the cover 70 open, and can store and/or remove the keys or other items inside of the storage compartment 22.

The modes of operation of the invention, locked, opened and combination reset, are described in greater detail below.

Locked Mode

Figure 3:
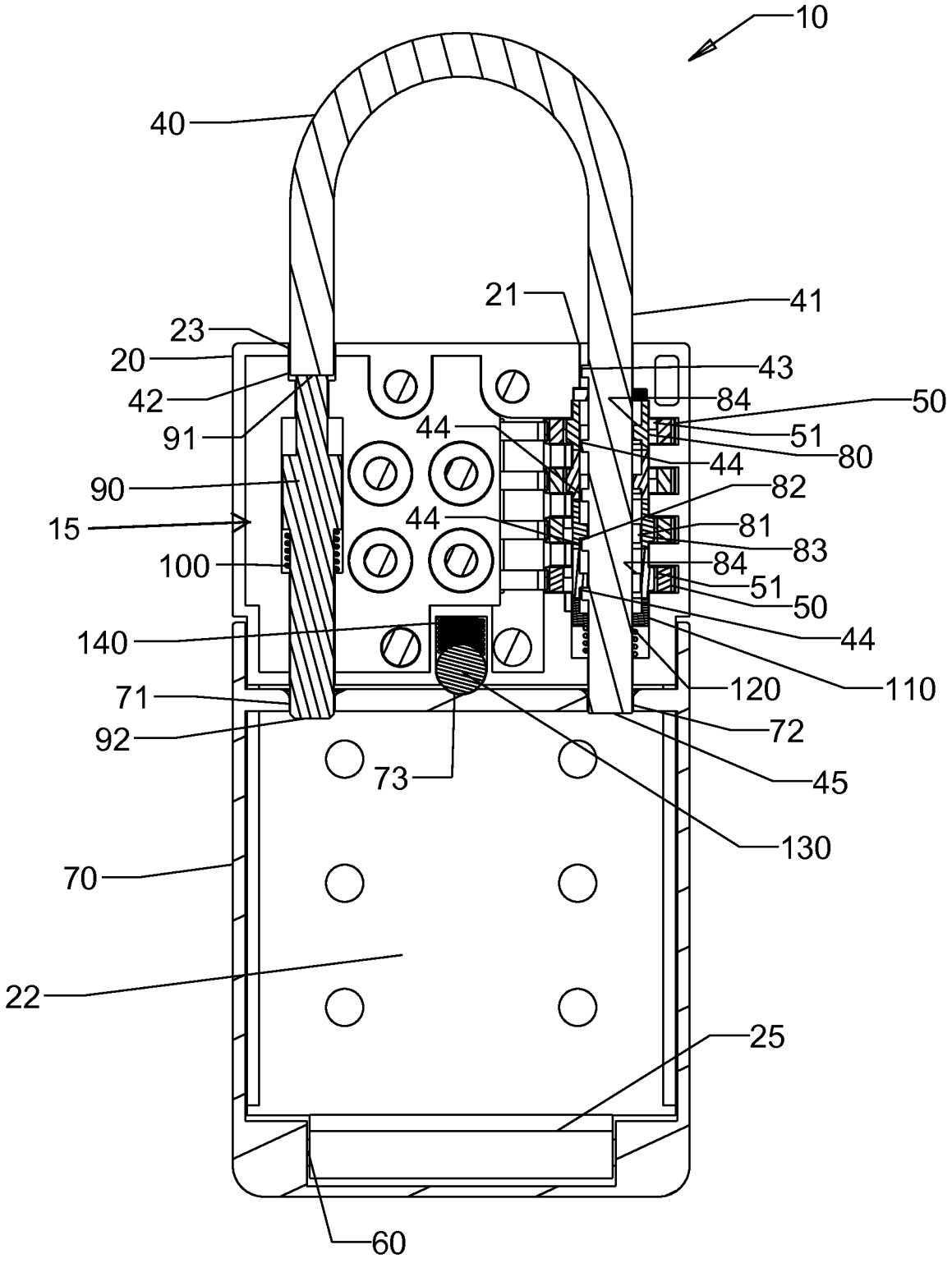
FIG. 3 shows a cross-sectional view of the combination key lock box according to the present invention in the locked position.

In the locked mode, shown for example in FIGS. 1 and 3, the combination is not aligned in the predetermined combination for opening the lock. Therefore, at least one of the plurality of lock-opening notches 81 of the clutches 80 is not aligned with the corresponding extended protrusion 44 of the shackle 40.

In the locked mode, the tube 90 is configured to push the shackle 40 upward such that at least one of the extended protrusions 44 will engage with the corresponding faulty notches 82 of the corresponding clutch 80 to prevent the dials 50 from rotating. The upward biasing of spring 100 causes the top end 91 of the tube 90 to push the short leg 42 of the shackle 40 upward, which also pushes long leg 41 and its extended protrusions 44 of the shackle 40 upward until the at least one of the extended protrusions 44 engages the corresponding faulty notches 82 of the clutches 80.

With such an arrangement, the dials 50 cannot be moved because at least one extended protrusion 44 of the shackle 40 engages at least one of the faulty notches 82 of the clutches 80 that will prevent the rotational movement of the clutches 80, which also prevents the rotational movement of the dials 50. As previously described, the dials 50 do not move because the teeth 51 of the dials 50 and the extended fin 83 of the clutch 80 are engaged together. Because the dials 50 are not free to rotate, the lock cannot be picked by feeling the correct combination by rotating the dials 50.

If one or more of dials 50 are set to the correct symbol in the combination, the configuration of the lock box 10 still prevents the particular dials 50 from being rotated. In such a circumstance, the extended protrusion 44 would be aligned with and contained in the corresponding lock-opening notch 81 of the clutch 80. The side walls of the lock opening notch 81 come into contact with the extended protrusion 44, thereby preventing the clutch 80 and the dial 50 from being rotatable in that position. The engagement of at least one of the plurality of extended protrusions 44 with at least one corresponding faulty notch 82 prevents the upward movement of the entire long leg 41 of the shackle 40, regardless of whether any of the other extended protrusions 44 are aligned with a corresponding lock-opening notch 81.

In the locked mode, the cover 70 is held in place by rod 60 which is riveted between the rod-receiving hole 24 at the bottom-end 25 of the storage compartment 22 of the first lock body 20. The cover 70 is closed, and the locking holes 71 and 72 of the cover 70 are engaged with the tail 92 of the tube 90 and the long leg end 45 of the shackle 40, which restrict any movement of the cover 70. With such an arrangement, the cover 70 cannot be pulled open, and the content which is placed inside of the storage compartment 22 is securely stored.

Opened Mode

Figure 2:
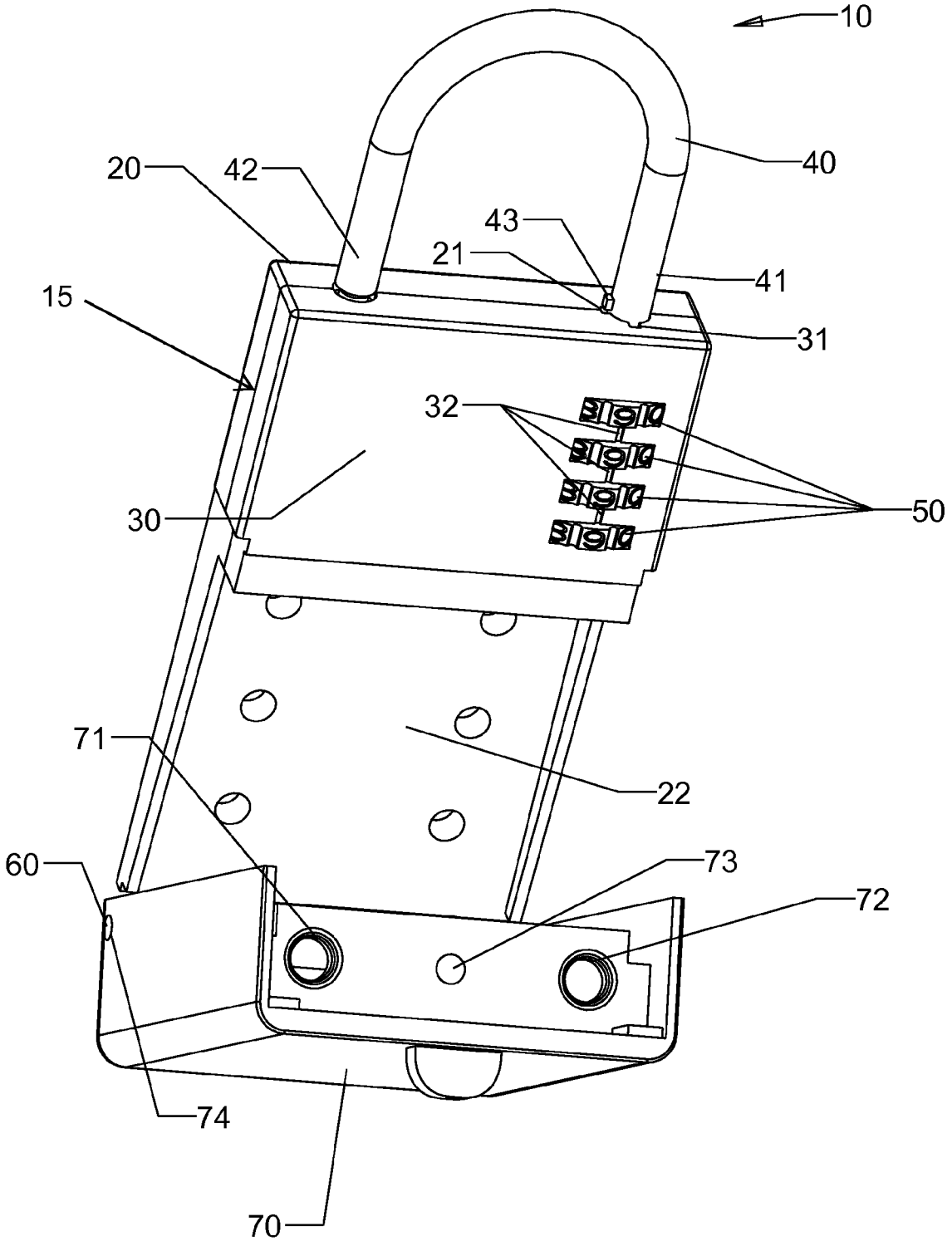
FIG. 2 shows the combination key lock box according to the present invention in the open position.
Figure 4:
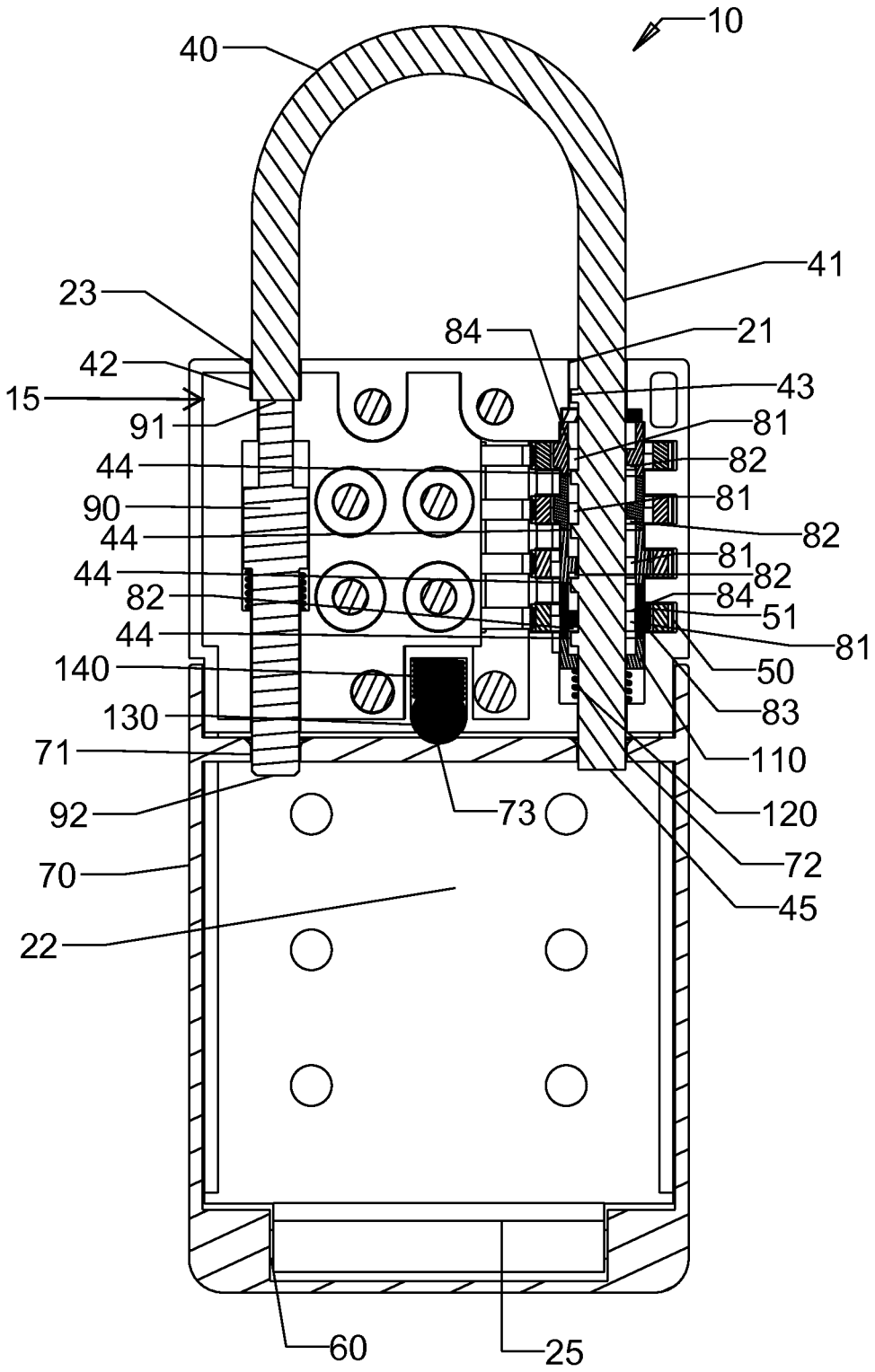
FIG. 4 shows a cross-sectional view of the combination key lock box according to the present invention wherein the shackle is engaged with the lock body.
Figure 5:
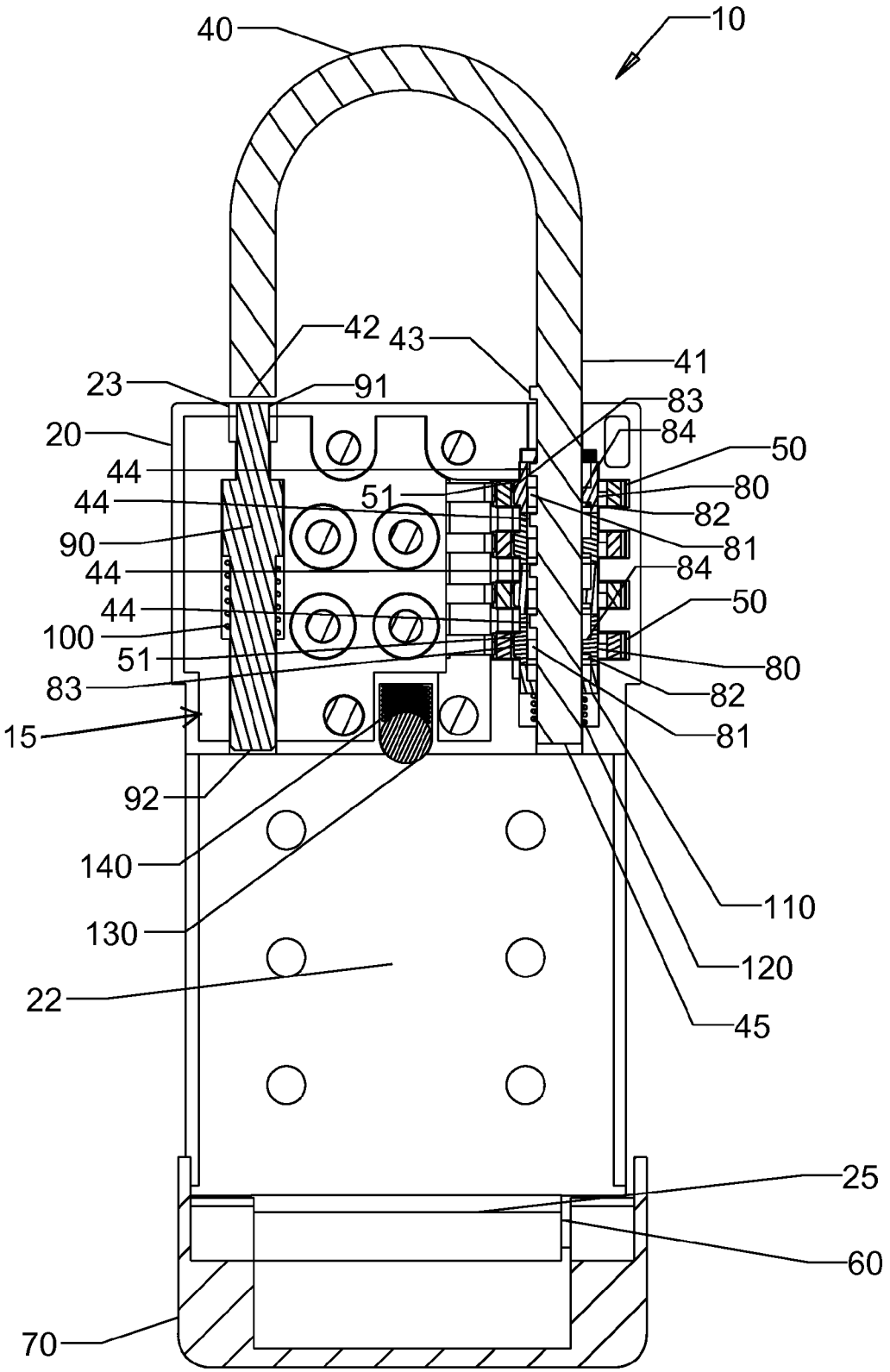
FIG. 5 shows a cross-sectional view of the combination key lock box according to the present invention wherein the shackle is extended out of the lock body.

The opened mode of the lock can be seen for example in FIGS. 2 and 4-5. In order to open the lock box 10, while in the locked mode, the user pushes and holds the shackle 40 downward into the body housing 15. The downward movement of shackle 40 and long leg 41 causes each of the extended protrusions 44 of the shackle 40 to disengage from the faulty-notch slots 82 and/or the lock-opening notches 81 of the clutches 80. By holding down the shackle 40, the factors that prevented the dials 50 and clutches 80 from rotating are removed.

The dials 50 can then rotate, which in turn rotates the clutch 80 in the same manner as explained above. As the user turns each dial 50 to achieve the correct combination, the lock opening notches 81 comes into alignment with the respective extended protrusions 44. When this alignment occurs for each extended protrusion 44 of the shackle 40, the shackle 40 is allowed to be pulled upward for opening. Adjacent to the openings for displaying the dials 50, the second lock body 30 comprises a series of indicators 32 to indicate where the alignment of the symbols on the dials 50 is made for entering the combination.

The combination is formed by a series of symbols, wherein each symbol in the combination indicates the position that each dial 50 must be in for the corresponding extended protrusion 44 to be aligned with the corresponding lock opening notch 81. When the correct combination, or sequence of symbols, are aligned on each of the dials 50, each corresponding extended protrusion 44 is aligned with each corresponding lock opening notch 81. Because of this alignment, the biasing effect of spring 100 on tube 90 and short leg 42 is no longer blocked as described above, but is able to force the short leg 42 of the shackle 40 out of the hole 23 of the body housing 15 into an open configuration. The protrusion 43 on the long leg 41 is further forced through the first slot 21.

As the shackle 40 moves upward, the long leg 41 of the shackle 40 disengages from the locking hole 72 of the cover 70 and the tube 90 is pushed upward by the spring 100 and the tail 92 disengages from the locking hole 71 of the cover 70. Because the tail 92 of the tube 90 and the long leg 41 of the shackle 40 disengage from the locking holes 71 and 72 of the cover 70, the cover 70 can be freely pulled open.

As shown in FIGS. 3-6, a ball bearing 130 is placed in the first and second lock bodies 20 and 30. The ball bearing 130 is received by a groove-cut 73 of the cover 70 in the lock mode. Ball bearing 130 is biased by a spring 140. When the cover 70 is closed, the ball bearing 130 will engage from the groove-cut 73 of the cover 70. In the open mode, as the shackle 40 is opened, the user will need to exert some force to overcome the ball bearing 130 to pull the cover 70. This force to the cover 70 is such that when the shackle 40 and tube 90 are in upward position, the cover 70 does drop suddenly and hit the user or drop the contents of the storage compartment 22. The user must pull the cover 70 to open because of the force applied by the ball bearing 130. The cover 70 may comprise a tab or other mechanism to aid the user in opening.

Resetting the Combination

Figure 6:
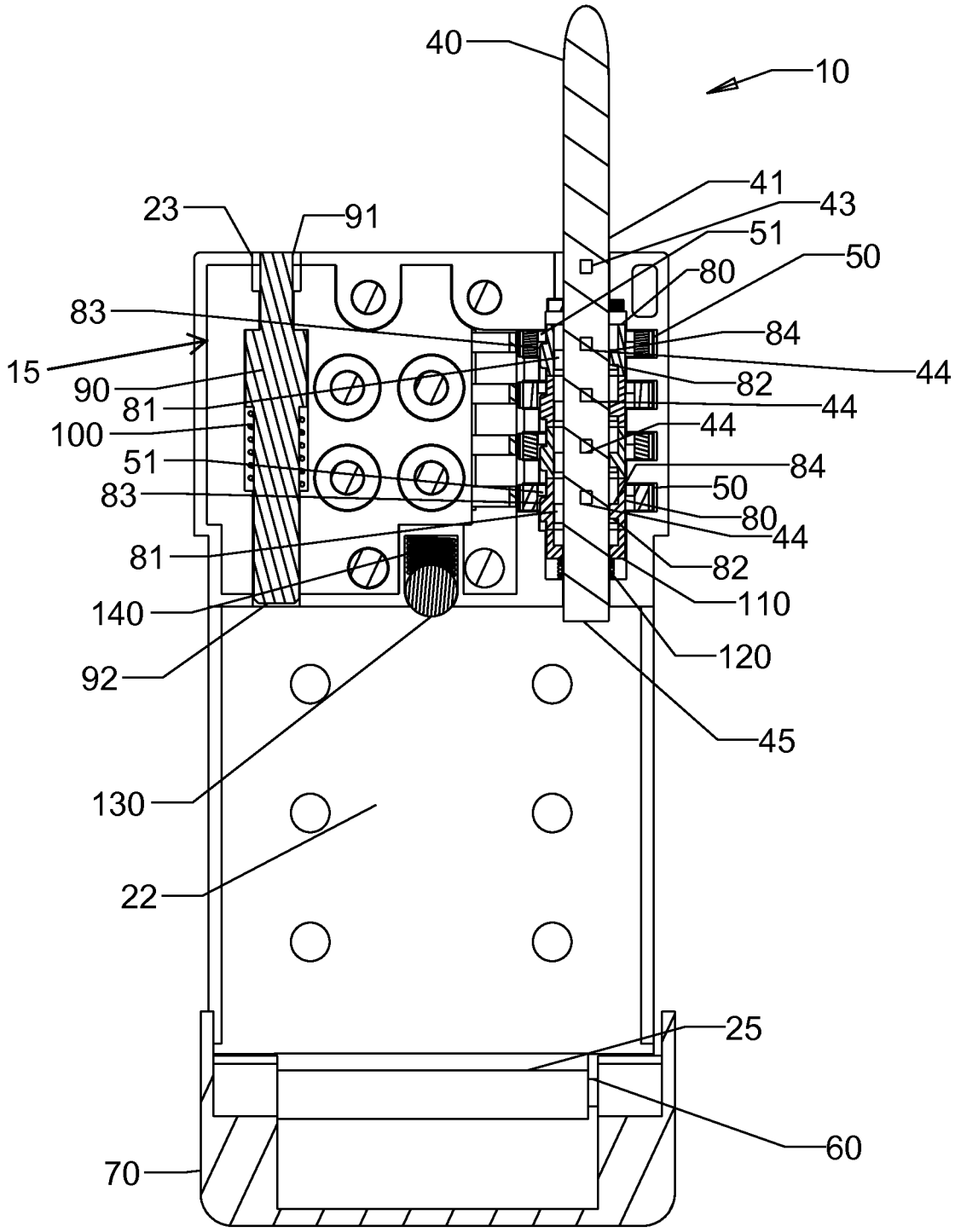
FIG. 6 shows a cross-sectional view of the combination key lock box according to the present invention in the position to reset the lock combination.

FIG. 6 shows the lock box 10 of the invention in the mode where the combination can be reset. When the shackle 40 is pulled upward in the open mode, the shackle 40 can rotate freely. The user can turn the shackle 40 at a pre-designated angle (e.g., counterclockwise 90 degrees) and push the shackle 40 downward into the body heading 15. As the shackle 40 is pushed downward, the protrusion 43 of the shackle 40 passes through the second slot 31 of the second lock body 30 and the extended protrusions 44 of the shackle 40 will contact the flat surface 84 of the clutches 80 and can push the set of clutches 80 downward. The downward movement of the clutches 80 disengages the respective extended fins 83 from each corresponding dial 50. As the extended fins 83 of the clutches 80 are no longer engaging the teeth 51 of the dials 50, the user can turn the dial 50 without also turning the clutch 80. This allows the user to turn the dials 50 to a new combination while each of the clutches 80 remains in a position where each extended protrusion 44 is aligned with each lock-opening notch 81. After the user sets the combination, the user can then release the shackle 40. A spring 120 is positioned underneath a spacer ring 110 beneath the arrangement of dials 50 and clutches 80. Upon release of the shackle 40, the spring 120 causes the spacer ring 110 and the clutches 80 to move upward. As the clutches 80 move back to the original position, the extending fins 83 of the clutches 80 will engage back to the teeth 51 of the dials 50.

Although the present invention has been described above with reference to the exemplary embodiment shown in the Figures, it should be noted that several alternative embodiments of the present invention exist without departing from the scope or spirit of the invention. For example, in alternative embodiments, the tube may be positioned beneath the long leg of the shackle. Additionally, the present invention is not limited to the particular number of dials/clutches or the number or type of symbols presented on the dials.

While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto. Furthermore, in the claims means-plus-function clauses are intended to cover the structures described herein as performing the recited function and not only structural equivalents, but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A combination lock box comprising:

a shackle comprising:

a first leg comprising a first protrusion and a plurality of second protrusions, and a second leg, a body housing having a first hole formed therein that is configured to receive the first leg of the shackle and a second hole formed therein that is configured to receive the second leg of the shackle;

a storage compartment comprising a cover;

a plurality of dials, each dial comprising a plurality of teeth; and a plurality of clutches, each clutch comprising:

an extended fin configured to engage the plurality of teeth of a respective dial, a lock-opening notch configured to allow one of the plurality of second protrusions to pass through the notch when each of the plurality of second protrusions are aligned with the lock opening notch of each of the plurality of clutches, and a plurality of faulty notches, each configured to block the movement of one of the plurality of second protrusions when the one of the plurality of second protrusions is engaged with the faulty notch;

wherein when the shackle is in a locked position, the plurality of clutches are configured to engage the first leg of the shackle to prevent the rotation of each of the plurality of dials; and wherein the shackle in the locked position is configured for downward movement towards the body housing and wherein the downward movement causes the plurality of second protrusions to disengage from any engagement with the plurality of faulty notches to allow rotation of the plurality of dials.

2. The combination lock box according to claim 1, further comprising a tube and a spring contained in a cavity formed in the body housing, wherein the spring is configured to bias the tube towards a first end of the tube adjacent to a base of the second leg of the shackle.

3. The combination lock box according to claim 2, wherein each of the plurality of dials comprises a plurality of symbols and the plurality of dials are configured to be rotatable to a predetermined combination of symbols, wherein the plurality of second protrusions of the shackle align with each of the plurality of lock-opening notches of the clutches and the shackle can be moved into an unlocked position when the plurality of dials are rotated to the predetermined combination of symbols.

4. The combination lock box according to claim 3, wherein the movement of the shackle into the unlocked position is configured to cause the spring to exert a force on the second leg of the shackle to push the shackle away from the body housing.

5. The combination lock box according to claim 1, wherein the cover further has formed therein cover holes configured to engage the first leg of the shackle and the second leg of the shackle when the shackle is in the locked position so as to prevent the opening of the storage compartment.

6. The combination lock box according to claim 2, wherein a second end of the tube comprises a tail configured for engaging a cover hole formed in the cover, when the shackle is in a locked position so as to prevent the opening of the storage compartment.

7. The combination lock box according to claim 1, wherein the cover further has a first cover hole formed therein configured to engage the first leg of the shackle when the shackle is in the locked position so as to prevent the opening of the storage compartment; and wherein the combination lock box further comprises: a tube and a spring contained in a cavity in the body housing, wherein the spring is configured to bias the tube towards the second leg of the shackle and wherein a second end of the tube comprises a tail configured for engaging a second cover hole formed in the cover when the shackle is in a locked position.

8. The combination lock box according to claim 7, wherein the spring is configured to exert a force on the tube and the shackle so as to cause the second end of the tube and the first leg of the shackle to disengage from and unlock the cover of the storage compartment.

9. The combination lock box according to claim 1, further comprising a ball bearing device configured to prevent the cover from falling open upon unlocking of the storage compartment.

10. The combination lock box according to claim 9, where the cover comprises a groove-cut to receive the ball bearing.

* * * * *